US007197907B2

(12) United States Patent
Birkenstock

(10) Patent No.: US 7,197,907 B2
(45) Date of Patent: Apr. 3, 2007

(54) METHOD FOR PRODUCING A PLURALITY OF CURVED EXTRUDED PROFILES

(75) Inventor: Alf Birkenstock, Heiligenhaus (DE)

(73) Assignee: WKW Erbsloh Automotive GmbH, Wuppertal (DE)

( * ) Notice: Subject to any disclaimer, the term of this patent is extended or adjusted under 35 U.S.C. 154(b) by 0 days.

(21) Appl. No.: 11/322,169

(22) Filed: Dec. 29, 2005

(65) Prior Publication Data

US 2006/0156780 A1 Jul. 20, 2006

Related U.S. Application Data

(63) Continuation of application No. PCT/EP2004/007126, filed on Jun. 30, 2004.

(30) Foreign Application Priority Data

Jul. 2, 2003 (DE) ..... 103 29 696

(51) Int. Cl.
*B21C 23/02* (2006.01)

(52) U.S. Cl. ..... 72/261; 72/254; 72/256; 72/257

(58) Field of Classification Search ..... 72/254, 72/256, 257, 260, 261, 264, 268, 269, 468
See application file for complete search history.

(56) References Cited

U.S. PATENT DOCUMENTS 2,189,415 A * 2/1940 Bell ..... 72/261
3,964,283 A * 6/1976 Fuchs, Jr. ..... 72/42
4,072,037 A * 2/1978 Fuchs, Jr. ..... 72/261
4,080,816 A * 3/1978 Ames et al. ..... 72/253.1
5,305,626 A * 4/1994 Tiekink ..... 72/257
6,634,200 B2 10/2003 Kleiner et al.
2004/0201126 A1 10/2004 Jakoby et al.

FOREIGN PATENT DOCUMENTS

DE 101 41 328 4/2003

(Continued)

OTHER PUBLICATIONS

International Preliminary Report on Patentability dated May 29, 2006.

*Primary Examiner*—Ed Tolan
(74) *Attorney, Agent, or Firm*—Katten Muchin Rosenman LLP

(57) ABSTRACT

The invention relates to a method for producing a plurality of bent extruded profiles (4; 5) from a light metal or light metal alloy, which is characterized by the following steps: simultaneously extruding at least two extruded profiles (4; 5) that are mirror-symmetric with respect to their cross-sectional shape while using an extrusion device (1), said extrusion device comprising an extrusion die (2) with an extrusion matrix forming the at least two extruded profiles (4; 5); at the same time bending the at least two extruded profiles (4; 5), while bending, when viewing the direction of extrusion and in a horizontal plane of viewing including the direction of extrusion, at least one of the extruded profiles (4; 5) or the projection thereof into the plane of viewing with a curvature that has a sign opposite the sign of the curvature with which at least one additional extrusion profile (5) or the projection thereof into the plane of viewing is bent.

11 Claims, 1 Drawing Sheet

FOREIGN PATENT DOCUMENTS

Figure 1:
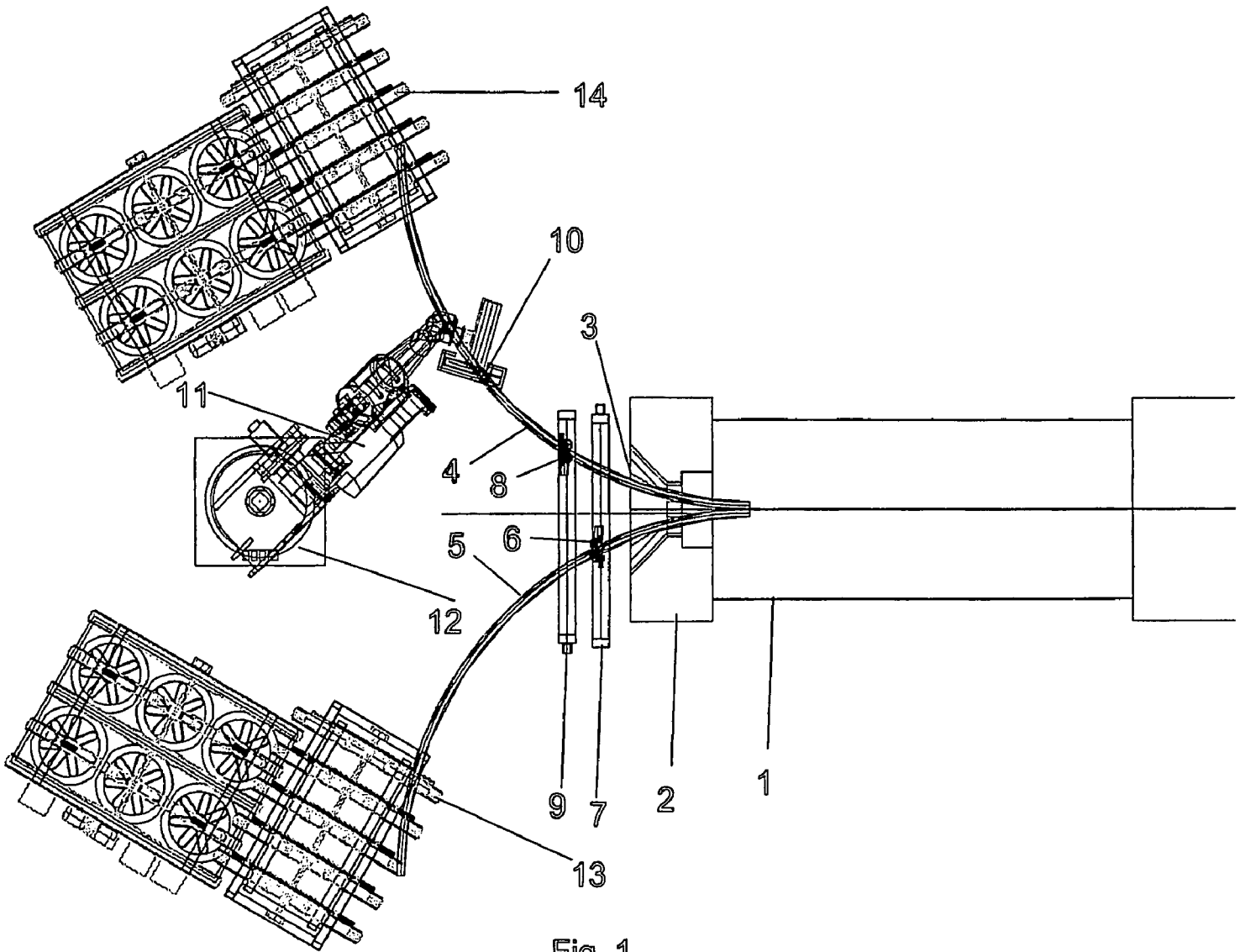

| | | | |
|---|---|---|---|
| EP | 0 706 843 A1 | | 4/1996 |
| EP | 0 706 843 B1 | | 4/1996 |
| GB | 2 283 930 | | 5/1995 |
| JP | 6-15372 | * | 1/1994 |
| WO | WO 94/04291 | | 3/1994 |
| WO | WO 01/58613 | | 8/2001 |

* cited by examiner

METHOD FOR PRODUCING A PLURALITY OF CURVED EXTRUDED PROFILES

CROSS-REFERENCE TO RELATED APPLICATION

This application is a continuation of International Application PCT/EP2004/007126 filed on Jun. 30, 2004, now International Publication WO 2005/002752 and claims priority from German Application 103 29 696.4 filed Jul. 2, 2003, the contents of which are herein wholly incorporated by reference.

The present invention relates to a method for producing a plurality of curved extruded profiles from light metal or a light metal alloy. The extruded profiles may have a complex hollow-profile cross section, which is understood as including in particular profiles with great differences in wall thickness but also profiles which have a small wall thickness with respect to the circumscribing circle of the extruded profile.

Profiled pieces of this type are used for example in automobile construction, for instance as structural elements such as window frames and roof racks, or as decorative components, such as trim strips and panels.

For the simultaneous production of a plurality of extruded profiles, it is known from WO 94/04291 A1 to use an extrusion die with four mirror-symmetrically arranged apertures for the profiles.

In the production of curved extruded profiles, individual strands are conventionally made to curve by rounding or bending. The disadvantage of this is that, in production, productivity depends on the extrusion rate that is used for the extrusion. However, there are limits to increasing the rate of extrusion, as a result of the increase in the extrusion pressure that this requires and the associated design of the extrusion device. This applies in particular to alloys that are difficult to extrude or alloys with a low discharge rate from the extrusion device, such as for example magnesium or its alloys or aluminum alloys that are difficult to extrude (for example 7000 alloys).

The object of the invention is to improve a method of the type mentioned above in such a way that the productivity of the extrusion device is increased.

This object is achieved by a method for producing a plurality of curved extruded profiles from light metal or a light metal alloy with the features of claim 1.

The "algebraic sign" of the curvature of an extruded profile is to be understood here in the conventional mathematical sense, i.e. with movement in the direction of extrusion an extruded profile is positively curved if it curves in the counterclockwise sense, while a negative curvature means a curvature in the clockwise sense. Curvature of two extruded profiles with opposite algebraic signs consequently means that one extruded profile is made to curve in the positive direction while another extruded profile is made to curve in the negative direction.

In the definition of the method according to the invention, a viewing plane has been introduced, since extruded profiles can not only be made to curve in a plane including the direction of extrusion, as it were two-dimensionally, but can generally be curved three-dimensionally in space.

The method according to the invention has the advantage that, by extruding and curving a number of extruded profiles, the productivity in the production of extruded profiles can be increased. Since the extruded profiles are provided with a curvature in such a way that the curvature of one extruded profile is contrary to the curvature of another extruded profile, it is possible for the extruded profiles to be made to curve simultaneously in the curving operation without hindering one another. By extruding and curving, for example, two extruded profiles by means of the method according to the invention, it can already be expected for productivity to be approximately doubled.

In the case of a particularly advantageous embodiment of the method according to the invention, the extruded profiles are made to curve with curvature of the same magnitude, but with an opposite algebraic sign. As in the conventional mathematical sense, the "magnitude" of a curvature is intended to mean the reciprocal value of the radius of a curvature. Curvature of extruded profiles with opposite algebraic signs and the same magnitude consequently means that the extruded profiles are curved mirror-symmetrically. If, furthermore, the extruded profiles are mirror-symmetrical in their cross-sectional shape, mirror-symmetrical workpieces can consequently be advantageously produced from the extruded profiles, such as for instance left-hand and right-hand workpieces, or front and rear workpieces. As a difference from the prior art, in which usually only individual strands are extruded one after the other, this avoids a time-consuming and consequently cost-intensive change of the extrusion tool for the extrusion of, for example, left-hand and right-hand profiled pieces in series. Further processing and stockkeeping is also made easier, since left-right or front-rear profiled pieces that belong together can be produced, further processed and stored together right from the outset. Furthermore, it is ensured that profiled pieces that belong together are produced from an identical starting material and under the same process conditions, so that any fluctuations in the material properties or the process conditions do not have any effects on profiled pieces that belong together.

In the case of a further advantageous embodiment of the method according to the invention, the extrusion die is formed in such a way that at least two extruded profiles lying one above the other are shaped. The at least two extruded profiles lying one above the other are subsequently made to curve simultaneously and with curvature of the same algebraic sign. In other words, the extruded profiles lying one above the other are made to curve exclusively positively or exclusively negatively. If, for example, a total of four extruded profiles are shaped by the extrusion die, two extruded profiles lying one above the other may have a positive curvature, while the other two extruded profiles lying one above the other have a negative curvature. In comparison with the conventional extrusion of individual strands, in this way it is essentially possible to achieve a fourfold increase in productivity.

The extruded profiles lying one above the other may advantageously not only have curvature of the same algebraic sign, but also curvature of the same magnitude. In process engineering terms, this means that extruded profiles of this type lying one above the other can be made to curve in the same way, and in particular also with a single guiding tool, which is designed for the processing of a number of extruded profiles.

In the case of an advantageous embodiment of the method according to the invention, the extruded profiles are not bent but rounded. In the case of rounding, the extruded profiles are made to curve at the same time as or immediately after the shaping extrusion operation by a force acting on the profile transversely in relation to the direction of extrusion, which brings about a curvature of the profile already as it leaves the extrusion die. Considered more precisely, a reaction to the force acting takes place, imparted via the extruded profile into the shaping zone, a force component acting as a tensile or compressive force having the effect of curving the extruded profile in the plastic state as it leaves the extrusion die. The force acting has the effect that the material flow on the outside of the curved extruded profile increases, while the material flow on the inside of the curved extruded profile decreases. The curved workpieces produced by rounding have profile cross sections that are identical to those which are produced in straight extrusion. In particular, rounding consequently also makes it possible for complex hollow-profile cross sections to be made to curve.

The rounding of workpieces is described in European Patent EP 0 706 843 B1, the full disclosure of which is incorporated herewith.

Furthermore, according to the invention, it is possible in an advantageous way that the curved extruded profiles are cut to length by a single parting tool, the parting tool being arranged practically in line with an extension of the axis of extrusion of the extrusion device. In the case of such an arrangement of the parting tool, it is possible for example for two emerging extruded profiles with curvature of opposite algebraic signs to be cut to length by a simple pivoting movement of the parting tool on a rotary base.

The method according to the invention can be used to increase productivity particularly advantageously in the case of extruding extruded profiles from magnesium or its alloys or from aluminum alloys that are difficult to extrude, since extruded profiles of these materials are distinguished by a particularly low discharge rate from the extrusion die.

Furthermore, it is preferred if, when they leave the die, the extruded profiles are deflected before bending in such a way that the strand discharge direction extends forward at an angle counter to the later curvature of a curved workpiece. With given dimensions of an extruder outlet, in particular the diameter of the opening cone of the counter piece, greater radii of curvature can be achieved as a result. Such a method is proposed in the international patent application WO 01/58613 A1, in which it is provided in the case of an extrusion device for the production of curved workpieces that the guiding surfaces of the die and/or the mandrel part producing the emerging strand are formed or arranged at an angle in a way corresponding to the strand discharge direction. The full disclosure of WO 01/58613 A1 is incorporated herewith.

The invention is now explained in more detail on the basis of an exemplary embodiment, reference being made to the accompanying drawing.

FIG. 1 shows a perspective view of an arrangement for extruding and rounding a plurality of extruded profiles according to the method of the invention.

In FIG. 1, an extrusion device 1 with a counter piece 2 is shown. Extruded profiles 4, 5 of a light metal or a light metal alloy emerge from the opening cone 3 of the counter piece 2. The extruded profile 4 is rounded by a guiding tool 6, which is guided on a linear axis 7. The extruded profile 5 is rounded by a guiding tool 8, which is guided on a linear axis 9. Here, a force, acting transversely in relation to the direction of extrusion on the profile, is exerted by the guiding tool 6 or 8 onto the extruded profile 5 or 4, respectively, at the same time as or immediately after the shaping extrusion operation, which force brings about a curvature of the profile already as it leaves the extrusion die. Since a reaction to the force acting takes place, imparted via the extruded profile into the shaping zone, a force component acting as a tensile or compressive force has the effect of curving the extruded profiles already in the plastic state as they leave the extrusion die.

The two extruded profiles 4, 5 are thereby provided with curvature of opposite algebraic signs in the horizontal plane including the direction of extrusion, i.e. the extruded profile 5 is positively curved in the direction of extrusion, while the extruded profile 4 is negatively curved.

The two extruded profiles 4, 5 are cut to length in the desired way by a single parting robot 11, bearing a parting saw 10. The parting saw 10 can be pivoted between the two extruded profiles 4, 5 by the pivoting arm, which is pivotably mounted on the rotary base 12 of the parting robot 11. After emerging from the extrusion device 1, the extruded profiles 4, 5 are guided on the guiding surfaces 13, 14 (delivery tables). Cutting the extruded profiles 4, 5 to length takes place in the intermediate space between the extrusion device 1 and the guiding surfaces 13, 14.

The invention claimed is:

1. A method for producing a plurality of curved extruded profiles from one of a light metal and a light metal alloy, the method comprising the steps of:

simultaneously extruding at least two extruded profiles to have mirror-symmetrically cross-sectional shapes by using an extrusion device, the extrusion device comprising an extrusion tool with an extrusion die shaping the at least two extruded profiles, while simultaneously curving the at least two extruded profiles to have, in the direction of extrusion and in a horizontal viewing plane of the direction of extrusion, a curvature with an algebraic sign opposite to that of the curvature with which at least one of one other extruded profile and a projection of the one other extruded profile into the viewing plane is curved.

2. The method as claimed in claim 1, wherein the extruded profiles are curved with a curvature of the same magnitude.

3. The method as claimed in claim 1, wherein the at least two extruded profiles are lying one above the other, are shaped by the extrusion die, and are simultaneously curved with curvature of the same algebraic sign.

4. The method as claimed in claim 3, wherein the at least two extruded profiles lying one above the other are curved with a curvature of the same magnitude.

5. The method as claimed in claim 4, characterized by the at least two extruded profiles lying one above the other are curved with a single curving tool.

6. The method as claimed in claim 1, wherein the extruded profiles are rounded with or immediately after the cross-sectional shaping extrusion operation by a force acting on the extruded profiles transversely in relation to the direction of extrusion, a force component acting as a tensile or compressive force in the cross-sectional shaping extrusion operation having the effect of curving the extruded profiles as they leave the extrusion die.

7. The method as claimed in claim 1, wherein the curved extruded profiles are cut to length by a single parting tool.

8. The method as claimed in claim 7, wherein the parting tool is arranged in line with an extension of the axis of extrusion of the extrusion device.

9. The method as claimed in claim 1, wherein the profile is made from a material selected from the group comprising magnesium, magnesium alloy and aluminum alloy.

10. The method as claimed in claim 1, wherein when the at least two extrude profiles leave the die, the extruded profiles are deflected before bending in such a way that a strand discharge direction extends forward at an angle counter to a later curvature of a curved workpiece.

11. A method for producing a plurality of curved extruded profiles from one of a light metal and a light metal alloy, the method comprising the steps of:

simultaneously extruding a pair of extruded profiles to have mirror-symmetrically cross-sectional shapes by using an extrusion device, the extrusion device comprising an extrusion tool with an extrusion die shaping the pair of extruded profiles, while simultaneously curving both profiles of the pair of extruded profiles to have, in the direction of extrusion and in a horizontal viewing plane of the direction of extrusion, a curvature with an algebraic sign opposite to that of the curvature of the other profile of the pair of extruded profile.

* * * * *